US008342096B2

(12) United States Patent
Greipl

(10) Patent No.: US 8,342,096 B2
(45) Date of Patent: Jan. 1, 2013

(54) AVALANCHE TRIGGERING SYSTEM

(75) Inventor: Werner Greipl, Schliersee (DE)

(73) Assignee: Technologie Alpine de Securite-Tas (FR)

( * ) Notice: Subject to any disclaimer, the term of this patent is extended or adjusted under 35 U.S.C. 154(b) by 495 days.

(21) Appl. No.: 12/280,598

(22) PCT Filed: Feb. 21, 2007

(86) PCT No.: PCT/FR2007/000315
§ 371 (c)(1),
(2), (4) Date: Sep. 13, 2010

(87) PCT Pub. No.: WO2007/096524
PCT Pub. Date: Aug. 30, 2007

(65) Prior Publication Data

US 2011/0005423 A1 Jan. 13, 2011

(30) Foreign Application Priority Data

Feb. 24, 2006 (FR) ..... 06 01648

(51) Int. Cl.
*F42D 3/00* (2006.01)

(52) U.S. Cl. ..... 102/363; 102/302

(58) Field of Classification Search ..... 102/363, 102/302, 324, 323, 322; 244/136
See application file for complete search history.

(56) References Cited

U.S. PATENT DOCUMENTS

| | | | | |
|---|---|---|---|---|
| 5,107,765 | A * | 4/1992 | Schippers | 102/302 |
| 6,324,982 | B1 * | 12/2001 | Eybert-Berard et al. | 102/363 |
| 6,644,203 | B1 * | 11/2003 | Powell | 102/315 |
| 7,707,938 | B2 * | 5/2010 | Hisel | 102/302 |
| 2006/0254449 | A1 * | 11/2006 | Hisel | 102/302 |
| 2011/0005423 | A1 * | 1/2011 | Greipl | 102/363 |
| 2011/0139029 | A1 * | 6/2011 | Farizy et al. | 102/322 |

FOREIGN PATENT DOCUMENTS

| | | | |
|---|---|---|---|
| DE | 4302252 | C1 * | 9/1993 |
| EP | 324723 | A2 * | 7/1989 |
| EP | 690285 | A1 * | 1/1996 |
| EP | 1035402 | | 9/2000 |
| EP | 1031008 | | 3/2003 |

OTHER PUBLICATIONS

International Search Report PCT/FR2007/000315; Dated Jul. 4, 2007.

* cited by examiner

*Primary Examiner* — Bret Hayes
*Assistant Examiner* — Joshua Freeman
(74) *Attorney, Agent, or Firm* — Cantor Colburn LLP

(57) ABSTRACT

The invention relates to an avalanche triggering system comprising a frame (4) fitted with means of attachment (5) for transporting the system, especially by helicopter with the aid of a cable (3), the frame (4) comprising, at the top, a storage area (6) for at least one gas container (7) designed to form an explosive mixture and, at the bottom, a holding system (8) for holding a plurality of balloons (9), each having an inflation sleeve and each being separated from the others, means (7, 13, 14) for conveying the explosive mixture to the inflation sleeve of a balloon (9), an injection nozzle (12), and means for igniting the explosive mixture, the balloon holding system (8) being mounted movably on the frame (4) to bring the inflation sleeve of each balloon (9) in succession up to the injection nozzle (12) and to the ignition means.

14 Claims, 3 Drawing Sheets

AVALANCHE TRIGGERING SYSTEM

TECHNICAL FIELD OF THE INVENTION

The invention relates to an avalanche triggering system for protecting sites such as roads, ski pistes, and built-up areas, especially after heavy snowfalls.

BRIEF DISCUSSION OF RELATED ART

A number of techniques exist for triggering avalanches intentionally.

One technique is to have an operator deposit an explosive charge in the slope where the avalanche is to be caused. The explosive can be placed in the slope by two methods, namely throwing and sliding the charge. As regards initiating the charge, this is traditionally done with a slow fuse or an electric fuse.

This first technique exposes the explosive's engineers to a number of risks. Their operations are necessarily performed at times when the snowpack is highly unstable and in dangerous areas. They are then exposed to the risk of avalanche, not only during the preparation and carrying out of the firing, but also on their way to and from the firing station, that is, the location where the firing is prepared and the charge is set off. These risks are the main cause of accidents during triggering operations.

Remote triggering techniques have developed so that explosives engineers do not have to travel and set up at altitude in dangerous areas. The objective is to move the firing station away from the firing point, that is away from the location of the charge at the moment of its explosion.

One remote triggering system is known as CATEX. This consists of a transporting cable for carrying an explosive to a predetermined firing area accessible to the transporting cable.

Although such a method does limit the risks to the operator, it can only be used to trigger avalanches in areas served by the cable. In addition such a technological method involves the transport and storage of explosives and therefore necessitates meeting stringent safety regulations. Lastly, installing a long distance transporting cable remains very expensive.

Another system is known as GAZEX. This is described in document FR 2 636 729. It comprises a barrel with a closed end and with a front mouth open in the direction of the snowpack. It also comprises an oxidizer gas delivery line and a fuel gas delivery line, the two gases coming from two separate sources. The nozzles for filling the barrel with these gases are situated in different parts of the barrel and an ignition device is mounted at the rear of the barrel. The explosive gaseous mixture, composed for example of propane and oxygen is formed in the barrel and the explosion is triggered by the ignition system.

Although this system has proved effective it has to be installed permanently in the at-risk area. It is therefore not easily transportable, which in turn means that one system has to be installed in each firing area.

U.S. Pat. No. 4,873,928 discloses a system for generating a shockwave exploding an explosive gas contained in a balloon. The device comprises an expansible balloon, a system for filling the balloon with an explosive mixture of oxygen and hydrogen and an ignition system designed to trigger the explosion.

Document EP 1 031 008 discloses a similar system in which the balloon is simply fixed to a support with the mouth pointing down, so that as it inflates, the balloon extends upwards.

The orientation of the explosion is such that a small part of the shockwave generated by the explosion of the balloon is transmitted to the snowpack.

Such a device does not therefore produce a satisfactory result. Specifically, since the balloon is fixed to a support and extends upward, most of the explosion goes up and sideways, the support being an obstacle to the shockwave travelling from the balloon to the snowpack. Once again, this remote triggering system is not transportable.

Other remote triggering techniques use military weapons. For example, the rocket launcher or mine launcher are used, essentially in Switzerland, while the recoilless gun or LoCAT shell launcher are used in the United States.

However, in some countries, particularly France, it is illegal to store initiated charges, which makes the use of such devices impossible.

BRIEF SUMMARY OF INVENTION

The invention provides a transportable avalanche-triggering system, in which the explosion is mainly directed toward the snowpack, which does not require the transport or storage of explosives, and the use of which is legal in the various countries.

For this purpose, the invention relates to an avalanche triggering system comprising a frame fitted with attachment means for carrying the system, notably by helicopter using a cable, the frame comprising, in the upper part, a storage space for at least one container of gas designed to form an explosive mixture, and in the lower part, a system for holding a plurality of elastic balloons, each having an inflation mouth directed in the upward direction, the body of each balloon extending in the opposite direction, the balloons being spaced apart from each other, means for delivering the explosive mixture to the inflation mouth of a balloon, an injection nozzle, and means for igniting the explosive mixture, means being provided to bring the injection nozzle and the ignition means in succession to the inflation mouth of each balloon.

The system can therefore be transported to different firing areas above the snowpack in order to set off an avalanche by exploding a balloon positioned on the underside of the device. Most of the explosion is thus directed toward the snowpack.

Moreover, since this system is equipped with several balloons, it is possible to set off a series of explosions and therefore either make certain of triggering an avalanche—because several firings are sometimes necessary—or trigger several avalanches in different areas without having to reload the system.

In a first variant of the invention, the balloon holding device is mounted moveably on the frame to bring the inflation mouth of each balloon in succession to the injection nozzle and to the ignition means.

In a second variant of the invention, the injection nozzle and the ignition means are mounted moveably on the frame to come in succession to the inflation mouth of each balloon.

In accordance with one feature relating to the first variant, the balloon holding system is formed by a barrel pivoted to the frame.

Simply rotating the barrel thus makes it possible to change the position of the balloons and so rearm the system in order to be able to set off another explosion.

The frame is advantageously equipped at its bottom end with a downwardly open cage for guiding and protecting the balloon during its inflation.

The purpose of the cage is to ensure that the balloon is not burst by collision with the rest of the system when the balloon is moved about by the swinging of the system or by the force of the wind on the balloon.

The protective guidance cage is preferably covered for at least part of its height, from its top, by a tapering skirt.

The skirt guides the wave of the explosion downward, thus improving the transfer of energy from the explosion to the snowpack. It also contributes to the production of the various components fitted to the frame.

Another feature of the invention is that the system comprises a video camera for monitoring the avalanche and/or the balloon.

The operator can thus monitor in real-time the inflation and explosion of the balloon and the condition and movement of the snowpack.

The explosive mixture delivery means advantageously comprise containers of the different constituent gases intended to form the explosive mixture, such as oxygen, hydrogen and/or propane, and a mixer intended to form the explosive mixture from the constituent gases.

The gases used to form the explosive mixture are cheap and do not require any special care in storage and transport or any specific preparation.

The balloons are preferably latex balloons. They may also be made of other elastic materials.

One further feature of the invention is that the ignition means are means for producing a flame or a spark.

The ignition means are advantageously built into the injection nozzle, to simplify the mechanism and the production of the device.

The injection nozzle is preferably moveable translationally between an inflation position, in which the injection nozzle is connected to the mouth of a balloon, and a retracted position, in which the injection nozzle is disconnected from the mouth.

In accordance with one feature of the invention, the balloons are distributed at regular intervals with a spacing of an angle $\alpha$ from one balloon to the next, the barrel being indexable rotationally through a multiple of the angle $\alpha$.

The indexed rotation of the barrel makes it a quick and simple task to change a balloon.

The balloon holding system, the explosive mixture delivery means, the injection nozzle, and the explosive mixture ignition means can advantageously be operated remotely by control means.

In this way an operator situated at a distance from the system, for example inside the helicopter transporting the system, can control the inflation and explosion of a balloon and the reloading of the system.

BRIEF DESCRIPTION OF THE DRAWINGS

A clear understanding of the invention will be gained from the following description, with reference to the appended schematic diagram illustrating, by way of non-restrictive example, an embodiment of this avalanche triggering system.

DETAILED DESCRIPTION OF THE INVENTION

Figure 1:
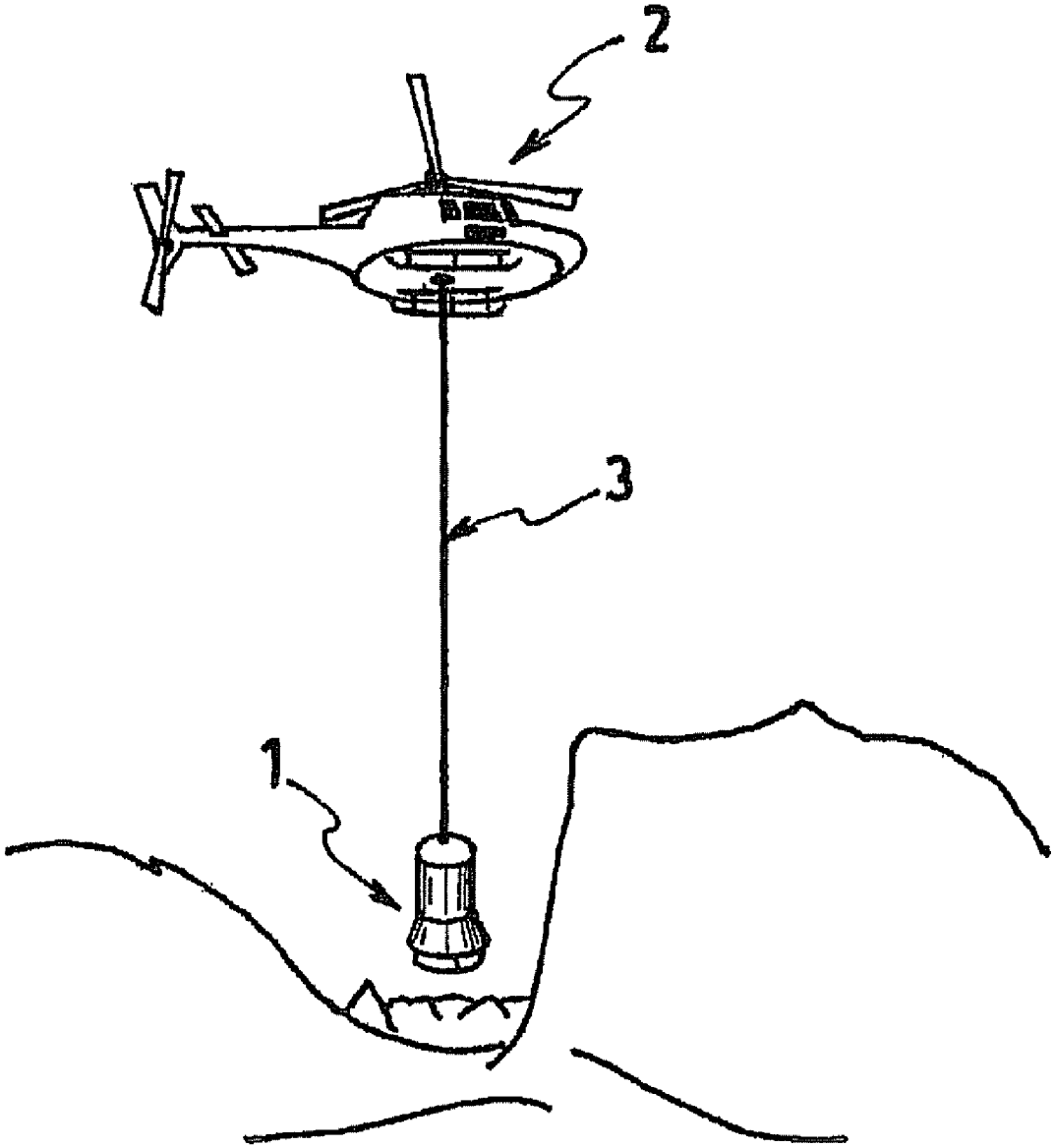
FIG. 1 is a general view of a helicopter transporting the system.

FIG. 1 shows an avalanche triggering system 1 connected to a helicopter 2 by a cable 3 of between 30 and 45 meters in length. The system is carried over the snowpack to the firing area.

Inside the helicopter 2 is an operator able to actuate the system 1 remotely via control means (not shown).

Figure 2:
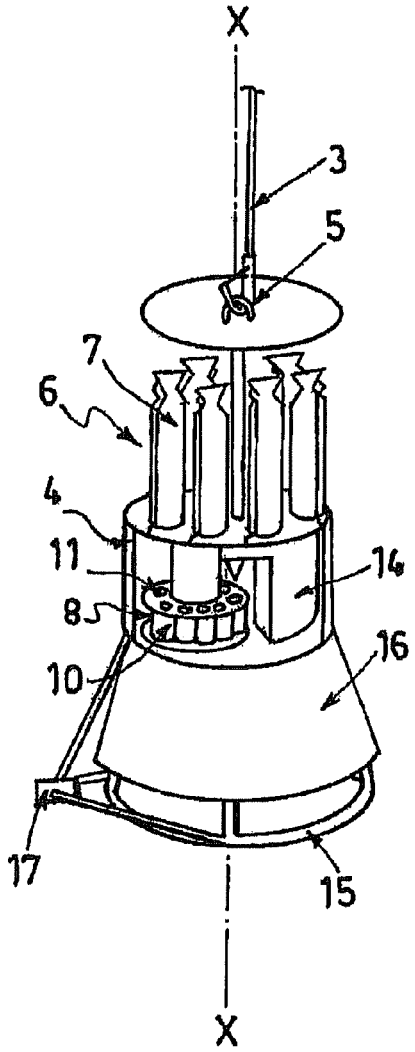
FIG. 2 is a perspective view of the system in a first condition in which the balloon is not inflated.

As shown in FIG. 2, this system 1 comprises a longitudinal frame 4 of roughly cylindrical shape fitted with attachment means 5 at a first end turned toward the helicopter 2. In a manner known per se, the attachment means are formed by a loop for a hook or karabiner attached to one end of the cable 3.

At the top of the frame is a space 6 for the storage of bottles 7 forming containers of oxygen and hydrogen or propane. The bottles are preferably distributed at regular intervals about the longitudinal axis X-X of the frame 4 in such a way as to balance the forces due to the weights of all the bottles 7. The frame 4 also comprises a barrel 8 mounted so as to be able to pivot about an axis Y-Y parallel to the longitudinal axis X-X of the frame 4 and offset to the side of the said longitudinal axis. The barrel 8 comprises a plurality of enclosures 10 open at both ends, with the deflated balloons 9 inside them. The balloons have inflation mouths, the opening of the mouths being uppermost and coinciding with the upper opening 11 of the enclosures 10 of the barrel 8.

The balloons 9 employed are latex balloons and are clamped to the enclosures 10, at their upper opening 11, in such a way as to provide a leaktight connection. The barrel 8 thus forms the support for a plurality of balloons 9 whose inflation mouths are uppermost and whose bodies are downmost so as to extend downward when inflated.

The frame 4 also comprises means for delivering an explosive mixture to the inflation mouth of the corresponding balloon, an injection nozzle 12 for injecting the explosive mixture and means for igniting the mixture (not shown).

Figure 6:
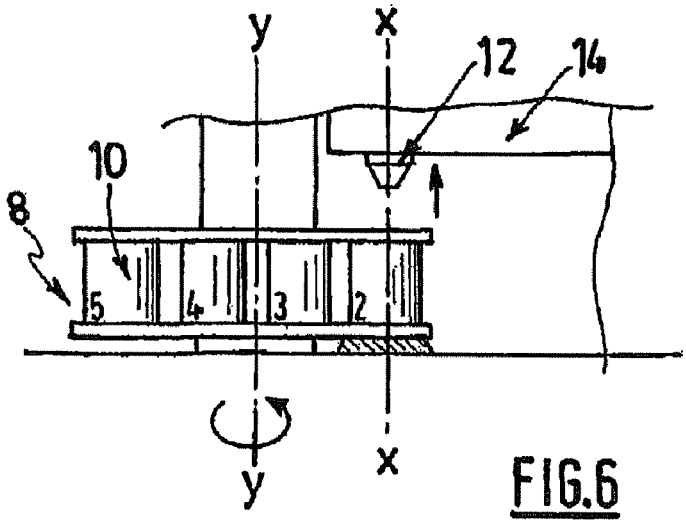
FIG. 6 is a view corresponding to FIGS. 4 and 5 and showing a third stage in the preparation of a second balloon.

The explosive mixture delivery means are formed by the oxygen or air bottles, the hydrogen or propane bottles, and a plurality of pipes 13 connecting each bottle to a mixer 14. The latter produces the explosive mixture. The mixture is then delivered to the injection nozzle 12, which, as FIGS. 6-8 show, inflates the balloon with the explosive mixture.

The explosive mixture ignition means initiate the explosion. They may consist of means for producing a flame or a spark.

The frame 4 also comprises a cage 15 which guides and protects the downward end of the balloon 9, that is to say the end directed toward the snowpack, once the system 1 is in the position of use.

Figure 3:
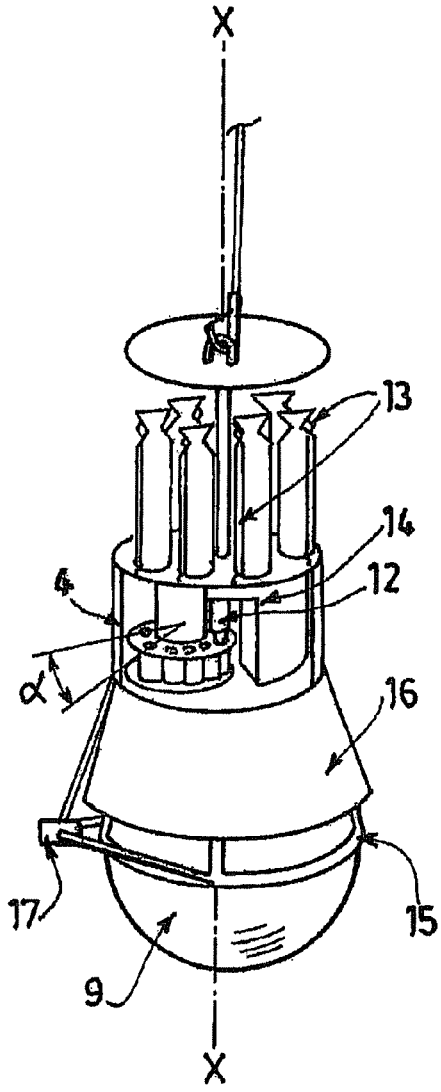
FIG. 3 is a view corresponding to FIG. 2 showing a second condition of the system in which the balloon is inflated.

As FIG. 3 shows, the balloon 9 is guided during its inflation by the cage 15, which is of generally hemispherical shape and is open in the downward direction. The cage 15 has a diameter corresponding to that of the inflated balloon, i.e. approximately 1.5 meters. Besides the function of guiding the balloon, the cage also protects it. The reason for this is that the swinging of the system 1 and the wind loading on the balloon 9 can cause the latter to swing about and burst it by colliding it with the system 1.

The protective guidance cage 15 is covered for part of its height, from its top, by a tapering skirt 16. This skirt 16 guides the waves produced by the explosion toward the snowpack. The energy of the explosion is thus not dissipated sideways and the effectiveness of the system is increased. The skirt 16 also protects the equipment mounted on the frame.

A video camera 17 for monitoring the avalanche and the balloon is mounted in the region of the lower end of the system 1 and to one side of the frame 4. The video camera 17 supplies images of the balloon 9 to the operator so that its inflation and explosion can be monitored. It also allows the operator to view the snowpack, particularly the area directly beneath the helicopter.

Figure 4:
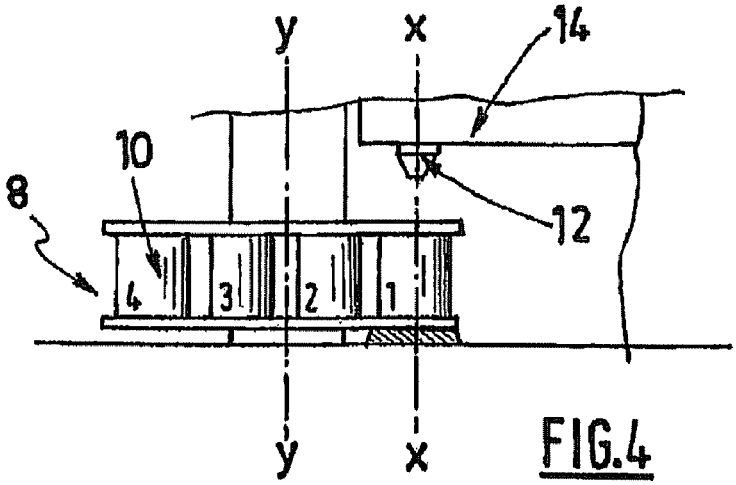
FIG. 4 is an enlarged side view of part of the system showing a first stage in the preparation of a first balloon.
Figure 5:
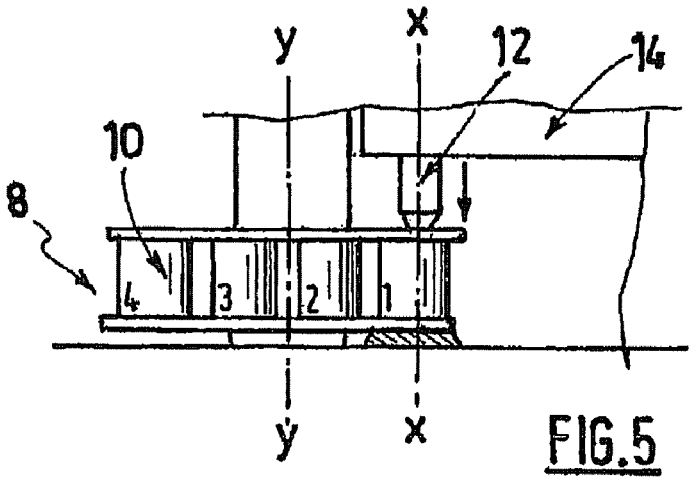
FIG. 5 is a view corresponding to FIG. 4 and showing a second stage in the inflation and ignition of the first balloon.

FIGS. 4-6 detail the process of inflating and exploding the balloons 9.

FIG. 4 shows a first stage in which a first enclosure 10 of the barrel 8 is positioned in such a way that the corresponding upper opening 11, and therefore also the mouth of the balloon 9, is aligned in the longitudinal axis of the injection nozzle 12, this axis corresponding to the longitudinal axis X-X of the frame 4. The injection nozzle 12 is in its raised position during this first stage.

In the second stage, shown in FIG. 5, the injection nozzle 12 is moved translationally toward the upper opening 11 of the enclosure 10. The injection nozzle 12 is then fitted leak-tightly to the mouth, ready to inflate the balloon 9 with the explosive gas mixture.

The increase in the volume of the balloon pushes it partly out of the lower opening of the corresponding enclosure 10 into the protective guidance cage 15.

The ignition means (not shown) are built into the injection nozzle 12 so that ignition can be performed directly after the balloon inflation stage. When the ignition means explode the balloon 9, the shockwaves produced by the explosion influence the snowpack.

After the explosion, the injection nozzle 12 is withdrawn from the upper opening 11 of the first enclosure and the barrel 8 is rotated through an angle $\alpha$ corresponding to the angular distance between the balloons. The barrel is thus indexable to position the upper opening of a second enclosure, directly next to the first enclosure, in the axis X-X of displacement of the injection nozzle 12 and of the ignition means, so that a second balloon contained in the second enclosure can be inflated.

The barrel 8 may for example contain eleven balloons allowing eleven consecutive explosions to be carried out without the system having to be reloaded, since the bottles 7 containing the gases are large enough to inflate all the balloons 9 in the barrel 8.

The avalanche triggering system also comprises means (not shown) for controlling the balloon holding system, the explosive mixture delivery means, the injection nozzle 12, and the explosive mixture ignition means. These control means comprise a control box forming an operator interface, this box allowing, in particular, control of the inflation and explosion operations either separately or automatically, for example by means of an inflation timer. They also comprise means of wireless connection between the various actuators of the system and the control box inside the helicopter. These wireless connection means may for example take the form of a radio transmitter and a radio receiver.

It goes without saying that the invention is not limited to only those embodiments of this system which have been described above by way of example but rather that it encompasses all variants. For example, the balloon holding system could take the form of a slider, the balloons being distributed at regular intervals along the slider and spaced apart by distance d, the slider being moveable in translational steps by a distance d, so that the slider may bring the inflation mouth of each balloon in succession to the injection nozzle and ignition means. Again, the ignition means may be separate from the injection nozzle; the explosive mixture may be of a different composition; the barrel need not necessarily be indexable; the tapering skirt may also be the protective guidance cage of the balloon; or the holding system is fixed relative to the frame, the injection nozzle and ignition means being designed to bring the inflation mouth of each balloon in succession to the injection nozzle and ignition means.

The invention claimed is:

1. An avalanche triggering system comprising a frame fitted with attachment means for carrying the system using a cable, the frame comprising, in an upper part, a storage space for at least one container of gas designed to form an explosive mixture, and in a lower part, a system for holding a plurality of elastic balloons, each having an inflation mouth directed in an upward direction, a body of each balloon extending in an opposite direction, the balloons being spaced apart from each other, means for delivering the explosive mixture to the inflation mouth of a balloon, an injection nozzle, and means for igniting the explosive mixture, means being provided to bring the injection nozzle and the ignition means in succession to the inflation mouth of each balloon.

2. The avalanche triggering system as claimed in claim 1, wherein the balloon holding system is mounted moveably on the frame to bring the inflation mouth of each balloon in succession to the injection nozzle and to the ignition means.

3. The avalanche triggering system as claimed in claim 1, wherein the injection nozzle and the ignition means are mounted moveably on the frame to come in succession to the inflation mouth of each balloon.

4. The avalanche triggering system as claimed in claims 1 or 2, wherein the balloon holding system is formed by a barrel pivoted to the frame.

5. The avalanche triggering system as claimed in claim 4, wherein the balloons are distributed at regular intervals and spaced apart from each other by an angle $\alpha$, the barrel being indexable rotationally through a multiple of the angle $\alpha$.

6. The avalanche triggering system as claimed in claim 1, wherein the frame is equipped at a bottom end with a downwardly open cage for guiding and protecting the balloon during inflation.

7. The avalanche triggering system as claimed in claim 6, wherein the protective guidance cage is covered for at least part of its height, from a top, by a tapering skirt.

8. The avalanche triggering system as claimed in claim 1, wherein it comprises a video camera for monitoring the avalanche and/or the balloon.

9. The avalanche triggering system as claimed in claim 1, wherein the explosive mixture delivery means comprise containers of the different constituent gases intended to form the explosive mixture and a mixer intended to form the explosive mixture from the constituent gases.

10. The avalanche triggering system as claimed in claim 1, wherein the balloons are latex balloons.

11. The avalanche triggering system as claimed in claim 1, wherein the ignition means are means for producing a flame or a spark.

12. The avalanche triggering system as claimed in claim 1, wherein the ignition means are built into the injection nozzle.

13. The avalanche triggering system as claimed in claim 1, wherein the injection nozzle is moveable translationally between an inflation position, in which the injection nozzle is connected to the mouth of a balloon, and a retracted position, in which the injection nozzle is disconnected from the mouth.

14. The avalanche triggering system as claimed in claim 1, wherein the balloon holding system, the explosive mixture delivery means, the injection nozzle, and the explosive mixture ignition means can be operated remotely by control means.

* * * * *